US009697946B2

(12) United States Patent
Otsubo

(10) Patent No.: US 9,697,946 B2
(45) Date of Patent: Jul. 4, 2017

(54) ELECTRONIC COMPONENT

(71) Applicant: Murata Manufacturing Co., Ltd., Kyoto (JP)

(72) Inventor: Yoshihito Otsubo, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 14/445,545

(22) Filed: Jul. 29, 2014

(65) Prior Publication Data

US 2014/0333407 A1 Nov. 13, 2014

Related U.S. Application Data

(63) Continuation of application No. PCT/JP2013/058228, filed on Mar. 22, 2013.

(30) Foreign Application Priority Data

Mar. 27, 2012 (JP) ..... 2012-071265

(51) Int. Cl.
*H01F 27/28* (2006.01)
*H01F 5/00* (2006.01)
*H01F 17/00* (2006.01)

(52) U.S. Cl.
CPC ..... *H01F 27/2804* (2013.01); *H01F 17/0013* (2013.01); *H01F 2017/004* (2013.01);
(Continued)

(58) Field of Classification Search
CPC ..... H01F 2027/2809
(Continued)

(56) References Cited

U.S. PATENT DOCUMENTS 5,552,756 A * 9/1996 Ushiro ..... 336/200
6,218,925 B1 4/2001 Iwao
(Continued)

FOREIGN PATENT DOCUMENTS

JP 01-151212 A 6/1989
JP 06-104132 A 4/1994
(Continued)

OTHER PUBLICATIONS

Japanese translation of WO2012008171.*
(Continued)

*Primary Examiner* — Elvin G Enad
*Assistant Examiner* — Ronald Hinson
(74) *Attorney, Agent, or Firm* — Pearne & Gordon LLP

(57) ABSTRACT

An electronic component is provided which includes a helical coil having good coil characteristics and high reliability without peeling or breakage in each insulator layer. As compared to an existing configuration in which coil patterns are disposed on insulator layers 2*a* to 2*d*, respectively, so as to fully overlap each other in a plan view, portions where coil patterns 11 to 14 intersect each other in a plan view are dispersed and the number of the coil patterns 11 to 14 overlapping each other in each intersection portion is small. Thus, a change in thickness of a multilayer body in which the respective insulator layers 2*a* to 2*d* are stacked is suppressed. Therefore, the pressure applied when the respective insulator layers 2*a* to 2*d* are pressure-bonded is uniformly transmitted to the entire multilayer body, and thus it is possible to provide an electronic component having good coplanarity and high reliability.

12 Claims, 6 Drawing Sheets

(52) U.S. Cl.
CPC ..... *H01F 2017/0066* (2013.01); *H01F 2027/2809* (2013.01)

(58) Field of Classification Search
USPC ..... 336/200, 223, 232
See application file for complete search history.

(56) References Cited

U.S. PATENT DOCUMENTS

| | | | | |
|---|---|---|---|---|
| 8,410,887 | B2 * | 4/2013 | Nanjyo et al. ..... | 336/200 |
| 2009/0256668 | A1 * | 10/2009 | Noma ..... | H01F 17/0013 336/200 |

FOREIGN PATENT DOCUMENTS

| | | | |
|---|---|---|---|
| JP | 09-055472 | A | 2/1997 |
| JP | 11-003829 | A | 1/1999 |
| JP | 11-260644 | A | 9/1999 |
| JP | 2012-164770 | A | 8/2012 |
| JP | 2012-178509 | A | 9/2012 |
| WO | 2009-081865 | A1 | 7/2009 |

OTHER PUBLICATIONS

International Search Report issued in Application No. PCT/JP2013/058228 dated May 7, 2013.
Written Opinion issued in Application No. PCT/JP2013/058228 dated May 7, 2013.

* cited by examiner

ELECTRONIC COMPONENT

BACKGROUND OF THE INVENTION

Field of the Invention

The present invention relates to an electronic component including a helical coil composed of coil patterns which are provided on the principal surfaces of a plurality of stacked insulator layers, respectively, and are connected in series in a stacking direction.

Description of the Related Art

Hitherto, an electronic component 500 has been known which, as shown in FIGS. 11 and 12, includes a helical coil 503 composed of coil patterns 502 which are provided on the principal surfaces of a plurality of stacked magnetic material layers 501 (insulator layers), respectively, and are connected in series in a stacking direction (see, e.g., Patent Document 1). The helical coil 503 configured as described above is surrounded by the magnetic material, thus causes less leakage of magnetism, and has good coil characteristics with high inductance. Therefore, there have been proposed electronic component modules, for example, various power modules such as charging circuits, DC-DC converters, and the like, and various high-frequency circuit modules, for example, various communication modules such as Bluetooth (registered trademark) modules, wireless LAN modules, and the like, antenna switch modules, and the like, all of which include the electronic component 500 including the helical coil 503. FIG. 11 is a perspective view showing the internal structure of an existing electronic component and FIG. 12 is a cross-sectional view of the electronic component in FIG. 11.

Patent Document 1: Japanese Unexamined Patent Application Publication No. 11-3829 (paragraphs 0017 to 0020, FIGS. 2 and 3, etc.)

BRIEF SUMMARY OF THE INVENTION

Meanwhile, as shown in FIGS. 11 and 12, each coil pattern 502 provided on each magnetic material layer 501 is arranged so as to overlap each other in a plan view. Therefore, in a multilayer body in which each magnetic material layer 501 is stacked, the thickness of a portion where the coil patterns 502 are formed is larger than the thickness of the other portion. Thus, when each magnetic material layer 501 is pressure-bonded, the applied pressure concentrates on the thick portion where the coil patterns 502 are formed to cause the positional shift of the coil patterns 502 or the breakage of the magnetic material layer 501 between the coil patterns 502 in the stacking direction, and hence the characteristics of the helical coil 503 formed by connecting the coil patterns 502 in series may be deteriorated.

In addition, when each magnetic material layer 501 is pressure-bonded, since the applied pressure concentrates on the thick portion where the coil patterns 502 are formed, the applied pressure is not sufficiently transmitted to the thin portion where no coil pattern 502 is formed, the pressure-bonding force at the thin portion is weakened, and peeling may occur in each magnetic material layer 501. Moreover, the thickness of each magnetic material layer 501 in the portion where the coil patterns 502 overlap each other in the stacking direction is smaller than the thickness of the other portion, and the thin portion of each insulator layer 501 is mainly located in the portion where the coil patterns 502 are arranged and overlap each other in a plan view, namely, in the multilayer body of the respective magnetic material layers 501, the thin portion of each magnetic material layer 501 is mainly located in the portion where the coil patterns 502 are formed. Therefore, when the multilayer body in which each magnetic material layer 501 formed from a thermosetting resin material or a ceramic material is stacked is thermally cured or fired, the magnetic material layer 501 [correction of clerical error] may break in the thin portion between the coil patterns 502 in the stacking direction due to the difference in heat shrinkage ratio between a metallic conductor forming the coil patterns 502 and a material forming the magnetic material layers 501 [correction of clerical error].

This invention has been made in view of the above-described problems, and it is an object of the invention to provide an electronic component which includes a helical coil having good coil characteristics and high reliability without peeling or breaking in each insulator layer.

In order to achieve the above-described object, an electronic component according to the present invention includes: a plurality of stacked insulator layers; and a helical coil composed of coil patterns each of which has a shape of a partially cut non-circular annular wiring electrode and which are provided on principal surfaces of the insulator layers, respectively, and are connected in series via an interlayer connection conductor in a stacking direction. The respective coil patterns are displaced such that the coil patterns connected in the stacking direction have an intersection portion in a positional relation thereof in a plan view.

In the invention configured as described above, the helical coil is formed by the coil patterns, each having a shape of a partially cut non-circular annular wiring electrode, being provided on the principal surfaces of the stacked insulator layers, respectively, and being connected in series via the interlayer connection conductor in the stacking direction. The respective coil patterns are displaced relative to each other such that the coil patterns connected in the stacking direction have intersection portions in a positional relation thereof in a plan view. Therefore, as compared to a configuration in which each coil pattern is disposed on each insulator layer so as to fully overlap each other in a plan view as in the related art, the portions where the respective coil patterns intersect and overlap each other in a plan view are dispersed, and the number of the coil patterns overlapping each other in each intersection portion is also small.

Thus, as compared to the related art, because the number of the coil patterns overlapping each other in each intersection portion is small, it is possible to improve the coplanarity (flatness) of the front surface of a multilayer board, it is easy to mount a mounted component on the multilayer board, and it is possible to improve the accuracy of the mounting.

In addition, when each magnetic material layer is stacked, thick portions which are formed by the coil patterns intersecting and overlapping each other and are thicker than the other portions are dispersedly located, and the pressure applied when each magnetic material layer is pressure-bonded is dispersed to the respective dispersedly located intersection portions of the coil patterns and applied to each magnetic material layer. Thus, the coil patterns are prevented from being positionally shifted, and the respective magnetic material layers between the coil patterns in the stacking direction are prevented from breaking. In addition, as compared to the related art, the number of the coil patterns overlapping each other in each intersection portion is small, and a change in thickness between the portions where the coil patterns overlap each other and the other portions is suppressed. Thus, the pressure applied when each magnetic material layer is pressure-bonded is uniformly transmitted to the entirety of each insulator layer as compared to the related art, and thus the occurrence of the peeling in a thin portion where no coil pattern is formed is prevented.

In addition, the thin portions of the respective magnetic material layers at the portions where the coil patterns overlap each other in the stacking direction of each magnetic material layer are dispersed within the multilayer body of the respective magnetic material layers. Thus, when the multilayer body in which each magnetic material layer formed from a ceramic material is stacked is fired, the breakage caused due to the difference in the heat shrinkage ratio between the wiring electrode forming the coil patterns and the material forming the magnetic material layers is prevented.

Therefore, it is possible to provide an electronic component module which includes a helical coil that prevents the positional shift of the coil patterns and has good coil characteristics, which has good coplanarity (flatness) and high reliability without peeling or breaking in each insulator layer.

In addition, the respective coil patterns may have the same shape.

With the configuration as described above, by merely providing the respective coil patterns having the same shape on the principal surfaces of the magnetic material layers, respectively, such that rotation angles thereof are slightly shifted from each other, it is possible to easily form a helical coil in which the respective coil patterns are displaced so as not to fully overlap each other such that the coil patterns connected in the stacking direction have intersection portions in a positional relation thereof in a plan view.

In addition, each of the coil patterns may have a polygonal shape, and the coil patterns connected in the stacking direction may be rotated so as to be displaced relative to each other in a positional relation thereof in a plan view. Moreover, each of the coil patterns may have an elliptical shape, and the coil patterns connected in the stacking direction may be rotated so as to be displaced relative to each other in a positional relation thereof in a plan view.

With the configuration as described above, since each of the coil patterns has a polygonal or elliptical shape, by merely providing the respective coil patterns on the principal surfaces of the magnetic material layers, respectively, such that the rotation angles thereof are slightly shifted from each other, it is possible to easily provide an electronic component having a practical configuration including the helical coil in which the coil patterns connected in the stacking direction are rotated to be displaced relative to each other in a positional relation thereof in a plan view.

In addition, the respective coil patterns may be disposed concentrically in a plan view.

With the configuration as described above, when the respective coil patterns are disposed concentrically in a plan view such that the rotation angles thereof are slightly shifted from each other, it is possible to obtain the following advantageous effects. Specifically, as compared to a configuration in which, in order that the respective coil patterns do not overlap each other, for example, coil patterns having different diameters are arranged periodically in the stacking direction, an area through which magnetic flux lines pass is restricted to be small by the stacked coil patterns having a small diameter, the inductance falls, and the decrease of the direct current superposition characteristics is prevented. Thus, it is possible to suppress the deterioration of the characteristics of the helical coil.

In addition, a plurality of the helical coils may be arranged side by side and embedded in the plurality of stacked insulator layers.

With the configuration as described above, by disposing the respective non-circular coil patterns forming each helical coil on the insulator layers in a state where the rotation angles of the respective non-circular coil patterns are adjusted with respect to each other, it is possible to provide an electronic component having a practical configuration in which the intervals between the respective coil patterns arranged side by side are adjusted and thus the mutual interference between a plurality of the helical coils arranged side by side is adjusted.

According to the present invention, as compared to an existing configuration in which coil patterns are disposed on insulator layers, respectively, so as to fully overlap each other in a plan view, portions where the coil patterns intersect each other in a plan view are dispersed and the number of the coil patterns overlapping each other in each intersection portion is small. Thus, a change in the thickness of the multilayer body in which the respective insulator layers are stacked is suppressed. Therefore, the pressure applied when the respective insulator layers are pressure-bonded is uniformly transmitted to the entire multilayer body, and thus it is possible to provide an electronic component which includes a helical coil that prevents the positional shift of the coil patterns and has good coil characteristics and high reliability without peeling or breakage of each of the insulator layers.

DETAILED DESCRIPTION OF THE INVENTION

First Embodiment

Figure 1:
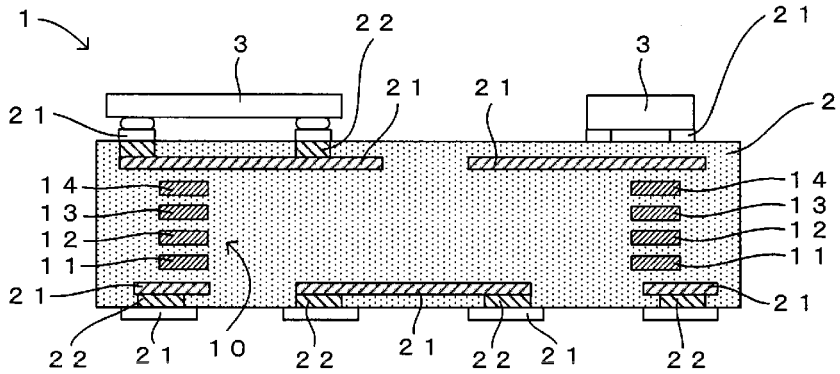
FIG. 1 is a diagram showing an electronic component module according to a first embodiment of an electronic component according to the present invention.
Figure 2:
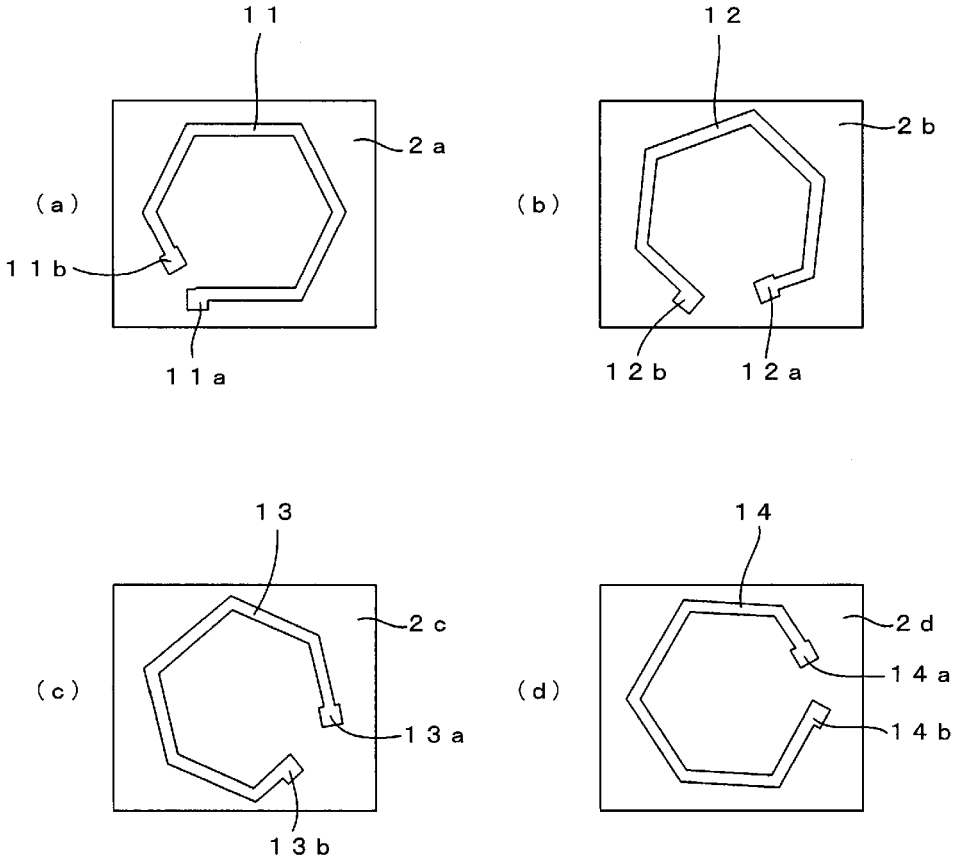
FIG. 2 is a plan view showing each coil pattern forming a helical coil included in the electronic component module in FIG. 1, in which FIGS. 2(*a*) to 2(*d*) show coil patterns formed on different insulator layers, respectively.
Figure 3:
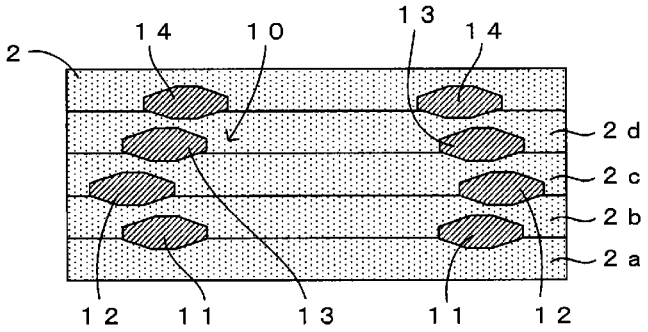
FIG. 3 is a cross-sectional view showing a positional relation between each coil pattern forming the helical coil in FIG. 2.
Figure 4:
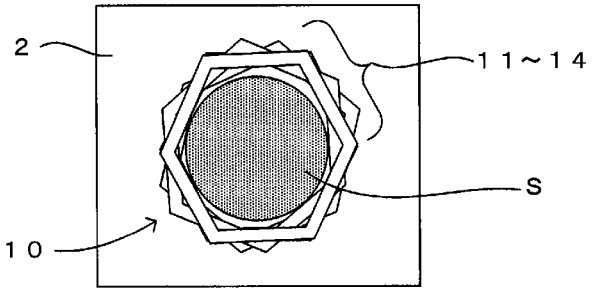
FIG. 4 is a plan view showing the positional relation between each coil pattern forming the helical coil in FIG. 2.

A first embodiment of the present invention will be described with reference to FIGS. 1 to 4. FIG. 1 is a diagram showing an electronic component module according to the first embodiment of an electronic component according to the present invention. FIG. 2 is a plan view showing each coil pattern forming a helical coil included in the electronic component module in FIG. 1, in which FIGS. 2(*a*) to 2(*d*) show coil patterns formed on different insulator layers, respectively. FIG. 3 is a cross-sectional view showing a positional relation between each coil pattern forming the helical coil in FIG. 2. FIG. 4 is a plan view showing the positional relation between each coil pattern forming the helical coil in FIG. 2. In FIG. 4, for easy explanation, a shape of a partially cut annular wiring electrode is omitted. In addition, also in FIGS. 5 to 10 to which reference will be made in the later description, a shape of a partially cut annular wiring electrode is omitted, but the description thereof is omitted in the subsequent description.

The electronic component module 1 shown in FIG. 1 forms various power modules such as LC modules and DC-DC converters, etc. and includes a multilayer board 2, components 3 mounted on a mounting surface of the multilayer board 2, and a helical coil 10 embedded in the multilayer board 2.

The multilayer board 2 is formed by stacking a plurality of magnetic material layers (insulator layers), and the respective magnetic material layers are formed by printing predetermined electrode patterns 21 and coil patterns 11 to 14 on ceramic sheets, formed from various magnetic materials such as a Fe—Ni—Zn—Cu based material, a Ni—Zn—Fe based material, a Ni—Zn—Cu based material, a Fe—Ni—Zn—CuO based material, a Fe—Mn—Zn based material, and the like, by using a conductor paste such as Ag, an Ag alloy such as Ag—Pd, Cu, or the like.

In addition, via holes are formed in each magnetic material layer by laser or the like, and via conductors 22 for interlayer connection (corresponding to "interlayer connection conductors" of the present invention) are formed by filling a conductor paste therein or plating the interior of the via holes. Each magnetic material layer is stacked in a predetermined order and fired, whereby the multilayer board 2 is formed.

The electrode patterns 21 exposed on the front surface and the back surface of the multilayer board 2 are plated with, for example, Ni—Au, the various components 3 are mounted on the electrode pattern 21 on the front surface, and the electrode pattern 21 on the back surface is connected to a mother board included in a portable information terminal or the like. In addition, in FIG. 1, for easy explanation, the via conductors 22 connecting the respective coil patterns 11 to 14 in series in the stacking direction of the magnetic material layers are omitted.

Chip components such as capacitors, resistors, and the like, ICs, and the like may be used as the components 3, and these components are selected as appropriate in accordance with the configuration and function of the electronic component module 1 and mounted on the mounting surface of the multilayer board 2.

As shown in FIG. 2, the helical coil 10 is formed by: stacking the respective magnetic material layers 2*a* to 2*d*, in which the coil patterns 11 to 14 are formed on the principal surfaces thereof, respectively, in order from the magnetic material layer 2*a* to the magnetic material layer 2*d*; and connecting the respective coil patterns 11 to 14 in series in the stacking direction via the via conductors 22. Specifically, the respective coil patterns 11 to 14 have the same regular hexagon shape, and, as shown in FIGS. 3 and 4, the respective coil patterns 11 to 14 are disposed concentrically in a plan view, and are rotated so as not to fully overlap each other and to be displaced relative to each other such that at least the coil patterns connected in the stacking direction have intersection portions in a positional relation thereof in a plan view.

In addition, one end 11*a* of the coil pattern 11 provided on the magnetic material layer 2*a* shown in FIG. 2(*a*) is connected to another end 12*b* of the coil pattern 12 provided on the magnetic material layer 2*b* shown in FIG. 2(*b*), via the via conductor 22, and one end 12*a* of the coil pattern 12 [correction of clerical error] provided on the magnetic material layer 2*b* is connected to another end 13*b* of the coil pattern 13 provided on the magnetic material layer 2*c*. In addition, one end 13*a* of the coil pattern 13 provided on the magnetic material layer 2*c* shown in FIG. 2(*c*) is connected to another end 14*b* of the coil pattern 14 provided on the magnetic material layer 2*d* shown in FIG. 2(*d*), via the via conductor 22, and another end 11*b* of the coil pattern 11 and one end 14*a* of the coil pattern 14 form input/output terminals of the helical coil 10.

In the helical coil 10 configured as described above, as shown in FIG. 3, the positions at which the coil patterns 11 to 14 intersect and overlap each other in the stacking direction are displaced relative to each other, and, as shown in FIG. 4, magnetic flux lines pass through an inner region S having a smallest inner diameter in a plan view of the respective coil patterns 11 to 14.

The number of stacked magnetic material layers on which the coil patterns are formed is not limited to the above example, and magnetic material layers may be further stacked to increase the number of the turns of the helical coil 10, or the number of the stacked magnetic material layers may be decreased to reduce the number of the turns of the helical coil 10.

In addition, each insulator layer forming the multilayer board 2 may be composed of a general dielectric ceramic layer, each insulator layer may be composed of a resin material such as glass-epoxy or the like, or magnetic material layers and dielectric layers may be used in combination for forming the multilayer board 2.

As described above, according to the above-described embodiment, the coil patterns 11 to 14 each having a shape of a partially cut non-circular annular wiring electrode are provided on the principal surfaces of the stacked insulator layers 2*a* to 2*d*, respectively, are disposed concentrically in a plan view, and are connected in series via the via conductors 22 in the stacking direction, whereby the helical coil 10 is formed. The respective coil patterns 11 to 14 are displaced relative to each other such that the coil patterns connected in the stacking direction have intersection portions in a positional relation thereof in a plan view. Therefore, as compared to a configuration in which each coil pattern is disposed on each insulator layer so as to fully overlap each other in a plan view as in the related art, the portions where the respective coil patterns 11 to 14 intersect and overlap each other in a plan view are dispersed, and the number of the coil patterns 11 to 14 overlapping each other in each intersection portion is also small.

That is, when each magnetic material layer forming the multilayer board 2 is stacked, thick portions which are formed by the coil patterns 11 to 14 intersecting and overlapping each other and are thicker than the other portions are dispersedly located, and the pressure applied when each magnetic material layer is pressure-bonded is dispersed to the respective dispersedly located intersection portions of the coil patterns 11 to 14 and applied to each magnetic material layer. Thus, the coil patterns 11 to 14 are prevented from being positionally shifted, and the respective magnetic material layers 2*a* to 2*d* between the coil patterns 11 to 14 in the stacking direction are prevented from breaking. In addition, as compared to the related art, the number of the coil patterns 11 to 14 overlapping each other in each of the intersection portions is small, and a change in thickness between the portions where the coil patterns 11 to 14 overlap each other and the other portions is suppressed. Thus, the pressure applied when each magnetic material layer is pressure-bonded is uniformly transmitted to the entirety of each insulator layer as compared to the related art, and thus the occurrence of the peeling in a thin portion where none of the coil patterns 11 to 14 is formed is prevented.

In addition, the thin portions of the respective magnetic material layers 2*a* to 2*d* at the portions where the coil patterns 11 to 14 overlap each other in the stacking direction of each magnetic material layer are dispersed within the multilayer body of the respective magnetic material layers. Thus, when the multilayer body in which each magnetic material layer formed from a thermosetting resin material or a ceramic material is stacked is thermally cured or fired, the breakage caused due to the difference in the heat shrinkage ratio between the wiring electrode forming the coil patterns 11 to 14 and the material forming the magnetic material layers is prevented.

Therefore, it is possible to provide the electronic component module 1 which includes the helical coil 10 that prevents the positional shift of the coil patterns 11 to 14 and has good coil characteristics and high reliability without peeling or breaking in each insulator layer.

In addition, by merely providing the respective coil patterns 11 to 14 having the same regular hexagon shape on the principal surfaces of the magnetic material layers 2*a* to 2*d*, respectively, such that rotation angles thereof are slightly shifted from each other, it is possible to easily form the helical coil 10 in which the respective coil patterns 11 to 14 are displaced so as not to fully overlap each other such that at least the coil patterns 11 to 14 connected in the stacking direction have intersection portions in a positional relation thereof in a plan view.

Moreover, when the respective coil patterns 11 to 14 are disposed concentrically in a plan view such that the rotation angles thereof are slightly shifted from each other, it is possible to obtain the following advantageous effects. Specifically, as compared to a configuration in which, in order that the respective coil patterns 11 to 14 do not overlap each other, for example, coil patterns having different diameters are arranged periodically in the stacking direction, the area of a region S through which magnetic flux lines pass is restricted to be small by the stacked coil patterns having a small diameter, the inductance falls, and the decrease of the direct current superposition characteristics is prevented. Thus, it is possible to suppress the deterioration of the characteristics of the helical coil. In addition, a coil pattern having a large diameter is not required in order to make the area of the region S, through which magnetic flux lines pass, to be equal to or larger than a predetermined size, thus it is possible to reduce the size of the region where the helical coil 10 is formed, and it is possible to reduce the size of the electronic component 1.

Furthermore, since each of the coil patterns 11 to 14 has a polygonal shape, by merely providing the respective coil patterns 11 to 14 on the principal surfaces of the magnetic material layers 2*a* to 2*d*, respectively, such that the rotation angles thereof are slightly shifted from each other, it is possible to easily provide the electronic component 1 having a practical configuration including the helical coil 10 in which the coil patterns connected in the stacking direction are rotated to be displaced relative to each other in a positional relation thereof in a plan view.

Second Embodiment

Figure 5:
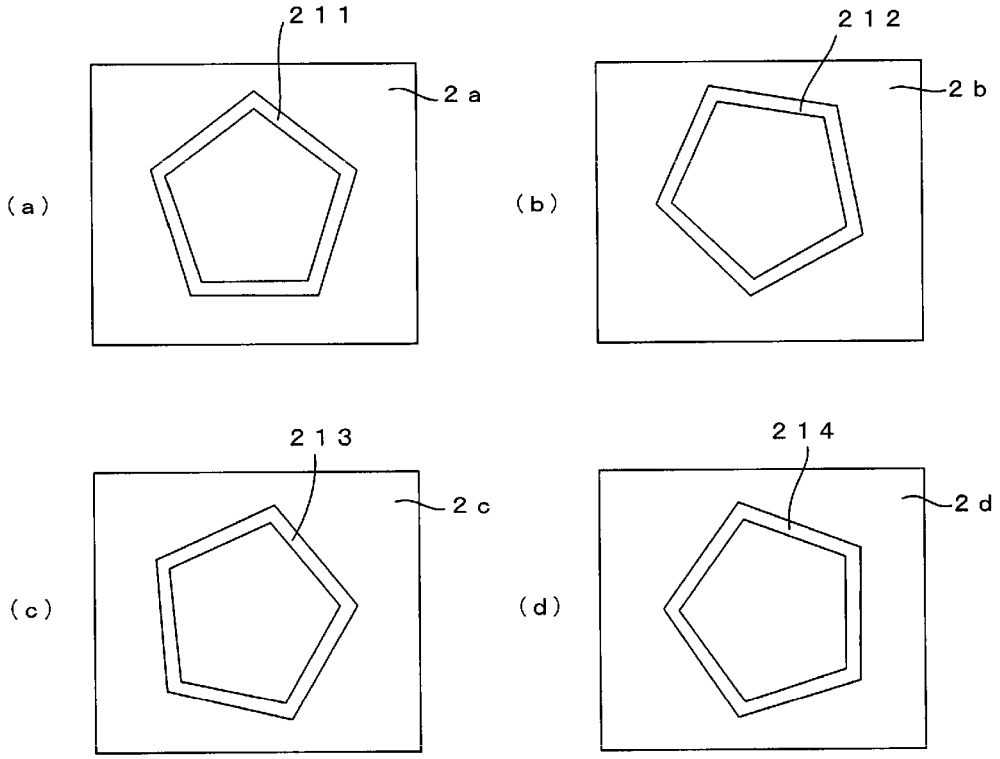
FIG. 5 is a plan view showing each coil pattern forming a helical coil according to a second embodiment of the present invention, in which FIGS. 5(*a*) to 5(*d*) show coil patterns formed on different insulator layers, respectively.
Figure 6:
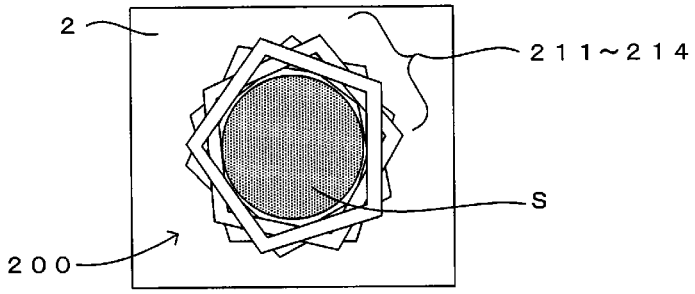
FIG. 6 is a diagram showing a positional relation between each coil pattern forming the helical coil in FIG. 5.

A second embodiment of the present invention will be described with reference to FIGS. 5 and 6. FIG. 5 is a plan view showing each coil pattern forming a helical coil according to the second embodiment of the present invention, in which FIGS. 5(*a*) to 5(*d*) show coil patterns formed on different insulator layers, respectively. FIG. 6 is a diagram showing a positional relation between each coil pattern forming the helical coil in FIG. 5. This embodiment is different from the first embodiment described above, in that as shown in FIGS. 5(*a*) to 5(*d*) and 6, a helical coil 200 is formed by stacking coil patterns 211 to 214 each having a regular pentagon shape. The other components are the same as those in the first embodiment, and thus the same reference signs are assigned to the components and the description of the components is omitted. In FIGS. 5 and 6, for easy explanation, each of the coil patterns 211 to 214 is shown as having a closed regular pentagon shape, and its opening portion (cut portion) and via conductors are omitted.

As described above, also in this embodiment, it is possible to obtain the same advantageous effects as those in the first embodiment.

Third Embodiment

Figure 7:
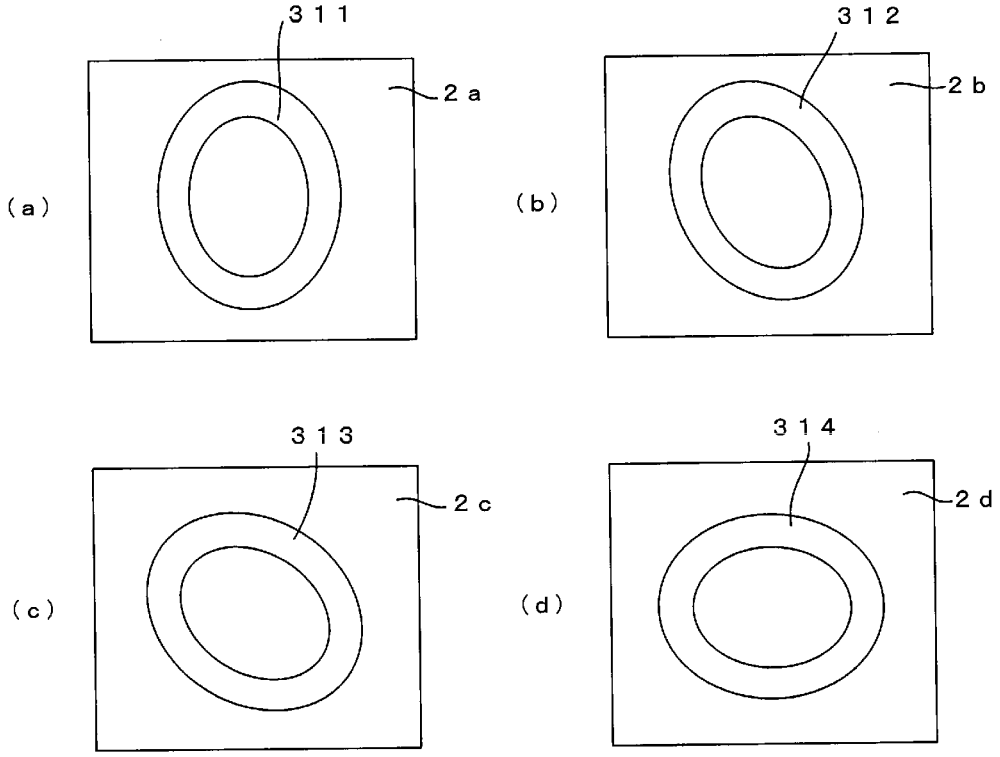
FIG. 7 is a plan view showing each coil pattern forming a helical coil according to a third embodiment of the present invention, in which FIGS. 7(*a*) to 7(*d*) show coil patterns formed on different insulator layers, respectively.
Figure 8:
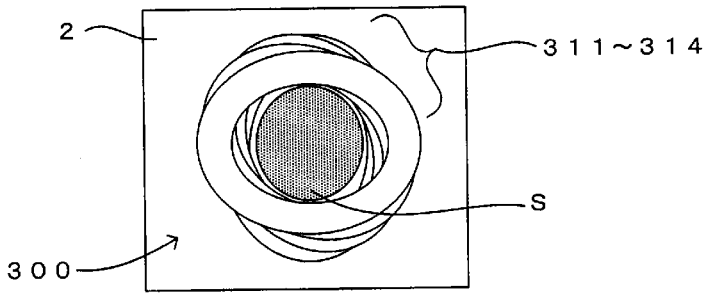
FIG. 8 is a diagram showing a positional relation between each coil pattern forming the helical coil in FIG. 7.

A third embodiment of the present invention will be described with reference to FIGS. 7 and 8. FIG. 7 is a plan view showing each coil pattern forming a helical coil according to the third embodiment of the present invention, in which FIGS. 7(*a*) to 7(*d*) show coil patterns formed on different insulator layers, respectively. FIG. 8 is a diagram showing a positional relation between each coil pattern forming the helical coil. This embodiment is different from the first embodiment described above, in that as shown in FIGS. 7(*a*) to 7(*d*) and 8, a helical coil 300 is formed by stacking coil patterns 311 to 314 each having an elliptical shape. The other components are the same as those in the first embodiment, and thus the same reference signs are assigned to the components and the description of the components is omitted. In FIGS. 7 and 8, for easy explanation, each of the coil patterns 311 to 314 is shown as having a closed elliptical shape, and its opening portion (cut portion) and via conductors are omitted.

As described above, by disposing the coil patterns 311 to 314 having an elliptical shape in a state where the coil patterns 311 to 314 are rotated so as to be displaced relative to each other in a positional relation thereof in a plan view, it is possible to obtain the same advantageous effects as those in the first embodiment.

Fourth Embodiment

Figure 9:
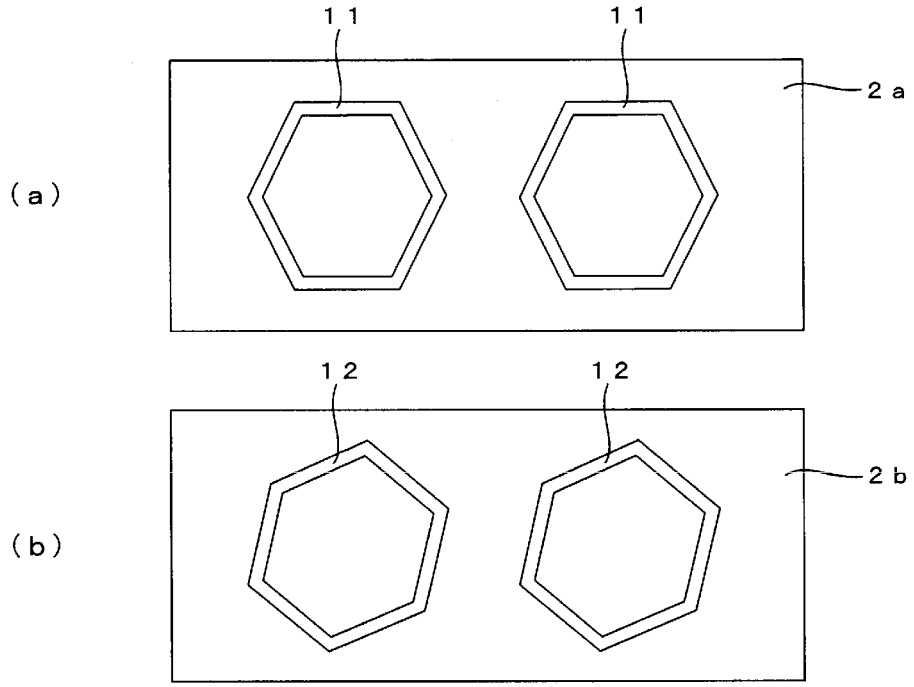
FIG. 9 is a plan view showing each coil pattern forming a helical coil according to a fourth embodiment of the present invention, in which FIGS. 9(*a*) and 9(*b*) show coil patterns formed on different insulator layers, respectively.

A fourth embodiment of the present invention will be described with reference to FIG. 9. FIG. 9 is a plan view showing each coil pattern forming a helical coil according to the fourth embodiment of the present invention, in which FIGS. 9(*a*) and 9(*b*) show coil patterns formed on different insulator layers, respectively. This embodiment is different from the first embodiment described above, in that as shown in FIGS. 9(*a*) and 9(*b*), helical coils 10 are arranged side by side and embedded in the multilayer board 2. The other components are the same as those in the first embodiment, and thus the same reference signs are assigned to the components and the description of the components is omitted. In FIGS. 9(*a*) and 9(*b*), for easy explanation, only the coil patterns 11 and 12 formed on the magnetic material layers 2*a* and 2*b* are shown, and the coil patterns 13 and 14 formed on the magnetic material layers 2*c* and 2*d* are omitted. In FIG. 9, for easy explanation, each of the coil patterns 11 and 12 is shown as having a closed non-circular shape, and its opening portion (cut portion) and via conductors are omitted.

With the configuration as described above, by disposing the respective non-circular coil patterns 11 and 12 forming each helical coil 10 on the magnetic material layers 2*a* and 2*b* in a state where the rotation angles of the respective non-circular coil patterns 11 and 12 are adjusted with respect to each other, it is possible to provide the electronic component 1 having a practical configuration in which the intervals between the respective coil patterns 11 and 12 arranged side by side are adjusted and thus mutual interference between a plurality of the helical coils 10 arranged side by side is adjusted. In addition, since the coil patterns 11 and 12 having the same shape are arranged side by side, it is possible to make the intervals between the coil patterns 11 and 12 on the respective magnetic material layers 2*a* and 2*b* to be substantially the same, and it is possible to prevent the deterioration of the characteristics of each helical coil 10 as compared to a configuration in which, by providing coil patterns having different diameters on the magnetic material layers [correction of clerical error] 2*a* and 2*b*, respectively, the intervals between the coil patterns are made different in each of the magnetic material layers 2*a* and 2*b*.

The number of the helical coils arranged side by side is not limited to two, and three or more helical coils may be arranged side by side.

Fifth Embodiment

Figure 10:
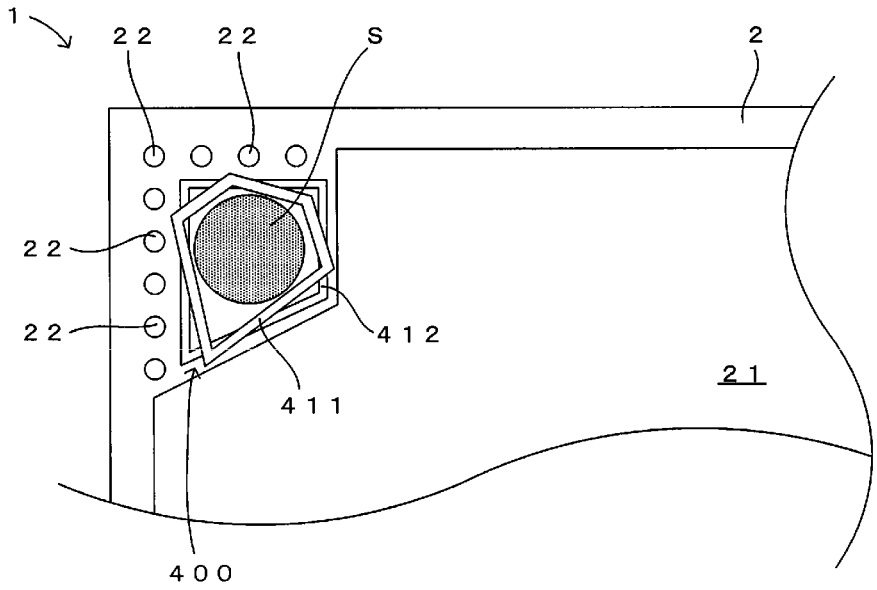
FIG. 10 is a diagram showing a positional relation between each coil pattern forming a helical coil according to a fifth embodiment of the present invention.
Figure 11:
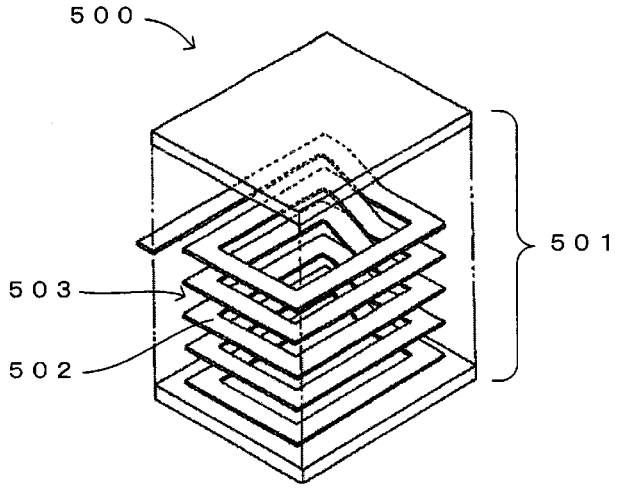
FIG. 11 is a perspective view showing the internal structure of an existing electronic component.
Figure 12:
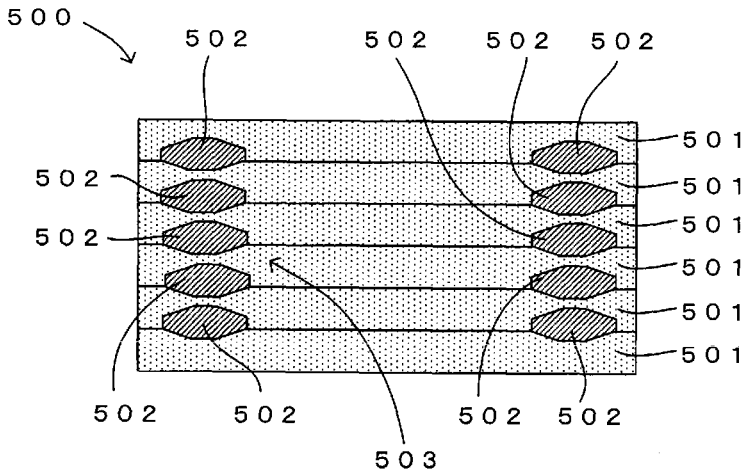
FIG. 12 is a cross-sectional view of the electronic component in FIG. 11.

A fifth embodiment of the present invention will be described with reference to FIG. 10. FIG. 10 is a plan view showing a positional relation between each coil pattern forming a helical coil according to the fifth embodiment of the present invention. This embodiment is different from each embodiment described above, in that as shown in FIG. 10, a helical coil 400 is formed by stacking coil patterns 411 and 412 having different shapes in a plan view. In other words, the helical coil 400 is disposed in a region of the multilayer board 2 included in the electronic component module 1 in which region no wiring pattern 21 and no via conductor 22 are provided, and the shapes of the coil patterns 411 and 412 may be made different in each layer in accordance with the shape of the region. The other components are the same as those in the first embodiment, and thus the same reference signs are assigned to the components and the description of the components is omitted. In FIG. 10, for easy explanation, each of the coil patterns 411 and 412 is shown as having a closed polygonal shape, and its opening portion (cut portion) and via conductors are omitted.

As described above, also in this embodiment, it is possible to obtain the same advantageous effects as those in the first embodiment.

The present invention is not limited to the above-described embodiments, and various changes other than the above may be made without departing from the gist of the present invention. In the above-described embodiments, the electronic component module has been described as an example of the electronic component according to the present invention, but the electronic component according to the present invention may be configured as a chip type component, and the chip type electronic component according to the present invention may be mounted on a wiring board forming various modules. In addition, the electronic component according to the present invention may be configured as a board-embedded type, and the form, the material, and the configuration thereof may be selected as appropriate in accordance with the intended use of the electronic component.

In addition, a resin mold layer may be provided on the mounting surface of the multilayer board 2 described above so as to cover the components 3. Moreover, for example, a thermoplastic resin may be used for the insulator layers forming the multilayer board 2.

The present invention is widely applicable to an electronic component including a helical coil composed of coil patterns which are provided on the principal surfaces of a plurality of stacked insulator layers, respectively, and are connected in series in a stacking direction.

1 electronic component module (electronic component)
2*a* to 2*d* magnetic material layer (insulator layer)
10, 100, 100*a*, 200, 300, 400 helical coil
11 to 14, 101, 102, 103, 211 to 214, 311 to 314, 411, 412 coil pattern
22 via conductor (interlayer connection conductor)

The invention claimed is:

1. An electronic component comprising:
a plurality of stacked insulator layers; and
one or more helical coils each composed of coil patterns each having a shape of a partially cut non-circular annular wiring electrode, provided on principal surfaces of the insulator layers, respectively, and connected in series via an interlayer connection conductor in a stacking direction of the insulator layers, wherein
each of the coil patterns is partially but not completely overlapped with any other ones of the coil patters when viewed in a planar view in the stacking direction,
wherein each of the coil patterns has a polygonal shape, and at least one corner portion of any one of the coil patterns is arranged outwardly from at least one side portion of any other one of the coil patterns in a direction perpendicular to the stacking direction, and
wherein each adjacent ones of the coil patterns in the stacking direction have at least two intersection portions intersecting with each other when viewed in a planar view.

2. The electronic component according to claim 1, wherein the coil patterns have the same shape.

3. The electronic component according to claim 1, wherein the coil patterns connected in the stacking direction are rotated so as to be displaced relative to each other in the positional relation in a plan view.

4. The electronic component according to claim 1, wherein the coil patterns are disposed concentrically in a plan view.

5. The electronic component according to claim 1, wherein the helical coils are arranged side by side and embedded in the plurality of stacked insulator layers.

6. The electronic component according to claim 2, wherein the coil patterns connected in the stacking direction are rotated so as to be displaced relative to each other in the positional relation in a plan view.

7. The electronic component according to claim 2, wherein the coil patterns are disposed concentrically in a plan view.

8. The electronic component according to claim 3, wherein the coil patterns are disposed concentrically in a plan view.

9. The electronic component according to claim 2, wherein the helical coils are arranged side by side and embedded in the plurality of stacked insulator layers.

10. The electronic component according to claim 3, wherein the helical coils are arranged side by side and embedded in the plurality of stacked insulator layers.

11. The electronic component according to claim 4, wherein the helical coils are arranged side by side and embedded in the plurality of stacked insulator layers.

12. The electronic component according to claim 1, wherein each of the coil patterns has a substantially same regular polygonal shape and is disposed concentrically, and any one of the coil patterns is arranged as rotated and displaced from any other ones of the coil patterns so as not to fully overlap each other in a direction perpendicular to the stacking direction.

* * * * *